US008317144B2

(12) United States Patent
Schouten

(10) Patent No.: US 8,317,144 B2
(45) Date of Patent: Nov. 27, 2012

(54) SYSTEM AND METHOD FOR STABILIZING VERTICALLY STACKED SHEET MATERIAL

(75) Inventor: Erik Schouten, Lititz, PA (US)

(73) Assignee: Rocksteady, LLC, Lititz, PA (US)

( * ) Notice: Subject to any disclaimer, the term of this patent is extended or adjusted under 35 U.S.C. 154(b) by 50 days.

(21) Appl. No.: 13/081,778

(22) Filed: Apr. 7, 2011

(65) Prior Publication Data

US 2011/0180675 A1 Jul. 28, 2011

Related U.S. Application Data

(63) Continuation-in-part of application No. 11/953,546, filed on Dec. 10, 2007, now Pat. No. 7,963,491.

(51) Int. Cl.
*A47B 96/06* (2006.01)

(52) U.S. Cl. ..... 248/218.4; 248/231.71; 248/309.1; 248/500; 24/380

(58) Field of Classification Search ..... 248/207, 248/218.4, 300, 309.1, 321.71, 499, 500; 52/127.2, 506.01, 749.1, DIG. 1
See application file for complete search history.

(56) References Cited

U.S. PATENT DOCUMENTS

| | | | | |
|---|---|---|---|---|
| 151,282 | A | | 5/1874 | Gudenoge et al. |
| 454,111 | A | | 6/1891 | Coupe |
| 1,477,482 | A | | 12/1923 | Harpin |
| 1,955,223 | A | | 4/1934 | Brouyette |
| 2,779,561 | A | | 1/1957 | Blundeau |
| 3,256,630 | A | | 6/1966 | Spector |
| 4,018,301 | A | | 4/1977 | Nameche |
| 4,164,269 | A | | 8/1979 | Jackson |
| 4,304,078 | A | * | 12/1981 | Meriwether, Jr. ..... 52/127.2 |
| 4,333,286 | A | | 6/1982 | Weinar |
| 4,455,716 | A | * | 6/1984 | Leonardo ..... 24/115 A |
| 4,498,272 | A | | 2/1985 | Adams |
| 4,502,619 | A | | 3/1985 | Cox |
| 4,709,891 | A | * | 12/1987 | Barnett ..... 248/214 |
| 4,801,121 | A | * | 1/1989 | Zunker ..... 248/551 |
| 4,924,971 | A | | 5/1990 | Rice |
| 4,939,821 | A | | 7/1990 | Frank, Jr. |
| 4,941,547 | A | | 7/1990 | Livick |
| 5,078,231 | A | | 1/1992 | Davis |
| 5,174,543 | A | | 12/1992 | Corson et al. |
| 5,228,657 | A | * | 7/1993 | Hall ..... 248/230.9 |
| 5,228,737 | A | * | 7/1993 | Zimmerman ..... 296/76 |
| 5,312,077 | A | * | 5/1994 | Gutierrez ..... 248/214 |
| 5,992,114 | A | | 11/1999 | Zelinsky et al. |
| 6,220,562 | B1 | | 4/2001 | Konkle |
| 6,293,058 | B1 | | 9/2001 | Sink |
| 6,427,803 | B1 | | 8/2002 | Moore |
| 6,668,509 | B1 | * | 12/2003 | Krebs ..... 52/698 |
| 6,725,613 | B2 | * | 4/2004 | Oliver et al. ..... 52/169.9 |
| 6,732,981 | B2 | | 5/2004 | Franks et al. |
| 6,976,339 | B1 | * | 12/2005 | Riccio et al. ..... 52/127.1 |
| 7,175,149 | B2 | | 2/2007 | Gallien |
| 7,543,789 | B2 | | 6/2009 | Lindberg |

* cited by examiner

*Primary Examiner* — Terrell McKinnon
*Assistant Examiner* — Daniel J Breslin
(74) *Attorney, Agent, or Firm* — McNees Wallace & Nurick LLC

(57) ABSTRACT

A system and method for stabilizing vertically stacked sheet material is disclosed. The sheet material may be construction wallboard. The system includes a bracket and an elongate flexible link element. The method includes attaching the bracket to the sheet material, attaching the flexible link element to a support structure such as vertical stud framing member, and attaching the flexible link element to the bracket to stabilize the vertically stacked sheet material.

13 Claims, 7 Drawing Sheets

SYSTEM AND METHOD FOR STABILIZING VERTICALLY STACKED SHEET MATERIAL

CROSS-REFERENCE TO RELATED APPLICATIONS

This application is a Continuation-in-Part of U.S. patent application Ser. No. 11/953,546 filed on Dec. 10, 2007, and claims priority to that application, which is herein incorporated by reference in its entirety.

FIELD OF THE INVENTION

The present invention is generally directed to the stabilization of stored material, and more particularly to a system and method for stabilizing vertically stacked sheets of construction material.

BACKGROUND OF THE INVENTION

One of the most common methods today of constructing walls and barriers includes the use of inorganic wallboard panels or sheets, such as gypsum wallboard, often referred to as wallboard or drywall. The term wallboard as used herein is intended to include construction material of a general flat sheet shape, including but not limited to gypsum wallboard.

North America is one of the largest gypsum walllboard users in the world with a total wallboard plant capacity of 40 billion square feet per year. Moreover, the home building and remodeling markets in North America have increased demand the last five years, with an average new American home containing more than 7 metric tons of gypsum. Additionally, the world market for gypsum as a construction material continues to grow.

Walls and ceilings made with gypsum wallboard panels are conventionally constructed by securing the wallboard with screws, nails, or other similar fasteners to structural members, for example, vertically and horizontally oriented pieces of wood or metal, commonly referred to as studs. Wallboard is typically supplied in standard-sized sheets or panels, and is frequently delivered to a construction site as stacks or bundles of wallboard.

The bundles of wallboard may contain approximately 26 to 30 individual sheets of wallboard. The wallboard is most frequently configured as 4 ft. by 12 ft. sheets, with each sheet weighing approximately 90 lbs. Wallboard is also provided in 4 ft. by 8 ft. and 4 ft by 16 ft. sheets. Thus, bundles of wallboard may weight between approximately 2340 lbs and 2700 lbs. The bundles of wallboard are delivered and stored at the construction site until needed.

At the construction site, the wallboard may be stored by horizontally stacking the wallboard on a horizontal surface, such as a flooring surface, or the wallboard may be vertically stacked, such as against an unfinished wall. The wallboard is often vertically stacked when the wallboard is being stored on a second floor or higher level at a construction site where horizontal storage space is not readily available. The wallboard may also vertically stacked on ground or lower floors if horizontal storage space is not available. The wallboard is often vertically stacked by leaning the wallboard against a stud wall proximate to the location where the wallboard will be installed. It is common practice in the construction industry to vertically stack wallboard with a very small lean angle to prevent damage to the wallboard. Often, the lean angle, the angle from vertical that the wallboard is leaned towards the supporting surface, may be up to approximately 20 degrees from vertical, and may be less than 5 degrees from vertical.

The term vertically stacked is intended to encompass lean angles up to approximately 20 degrees from vertical for the remainder of this discussion. The small lean angle creates an unstable stack of wallboard that may be tipped over by a small unintentional force.

The vertically stacked wallboard presents a safety problem at construction sites since the wallboard may be subjected to unintended external forces, such as wind or accidental work site contact, which may cause the wallboard to unintentionally fall away from it's vertically stacked orientation. Because of the wallboard's considerable weight and size, serious personal injury may result from such unintentional movement of the wallboard, either by contacting a person or forcing a person into an unsafe position.

Because the wallboard is used as a wall surface, it is not practical to temporarily fix the wallboard directly to a vertical surface, such as a stud, by nailing or other destructive methods. Furthermore, providing supports and/or structures to temporarily stabilize the wallboard is not practical due to the fast pace at which the wallboard is used.

What is needed is a system and method to stabilize substantially vertically oriented wallboard that is inexpensive and simple to install.

SUMMARY OF THE INVENTION

A first aspect of the disclosure includes a stabilization system for stabilizing a vertically oriented sheet of material. The stabilization system includes a bracket including a front leg, a rear leg separated by a gap from the front leg, and a top section disposed between the front leg and the rear leg, a flexible link element traversing through the top section, and a fastener configured to securely retain the flexible link element at a fixed position.

A second aspect of the disclosure includes a method for stabilizing a vertically stacked bundle of sheet of material. The method includes providing one or more vertically stacked sheets of material supported against a vertical support surface, mounting a bracket over a top edge of an outer sheet of the vertically stacked bundle of sheet of material, securing a flexible link element that is attached to the bracket to a component of the vertical support surface, and securely fastening the flexible link element to the bracket to stabilize the vertically stacked sheet of material against the vertical support surface.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
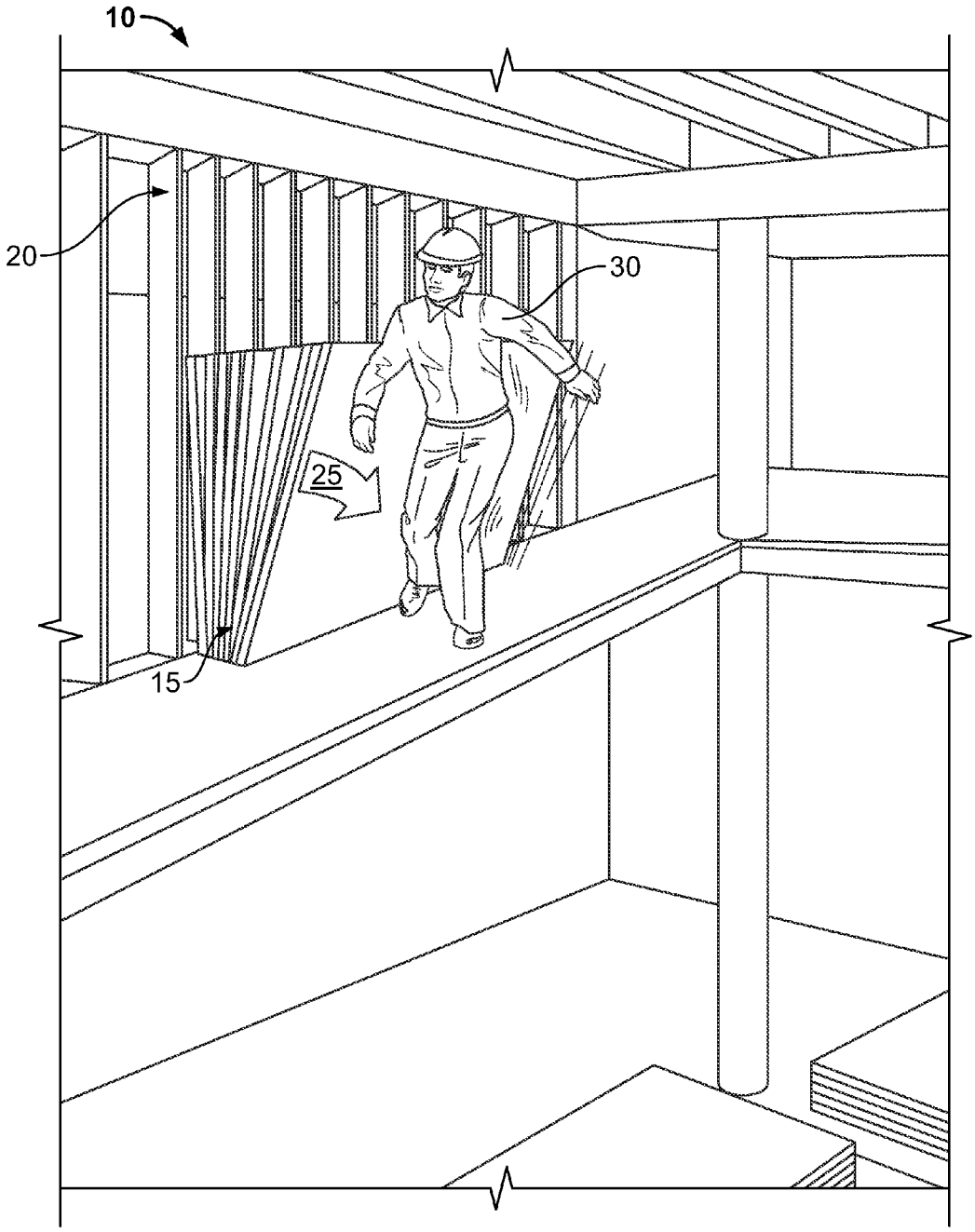
FIG. 1 illustrates of a construction site scenario where an embodiment of the stabilization system and method of the invention may be applied.

FIG. 1 shows an illustration of a construction site scenario 10 that may be prevented by the system and method according to the present invention. As can be seen in FIG. 1, a bundle of wallboard 15, which has been vertically stacked against a vertical structure 20, has become destabilized and is falling in the direction of the arrow 25. In this exemplary embodiment, the vertical structure 20 is one or more vertical wall studs. In another embodiment, the vertical structure 20 may be a wall, studs, panels or other similar vertical structure. The falling bundle of wallboard 15 is shown as either striking the worker 30 or forcing the worker 30 into an unsafe position.

Figure 2:
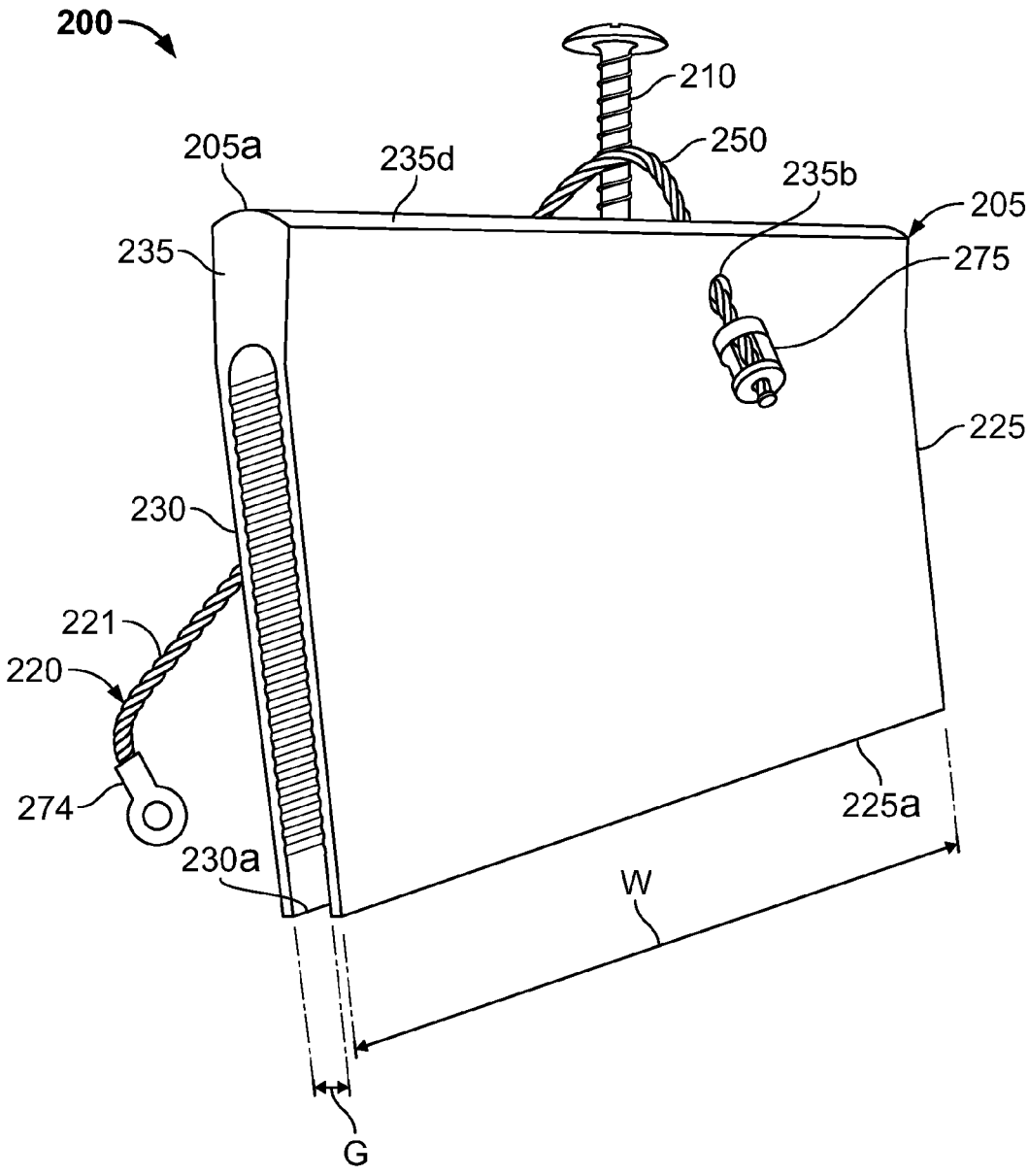
FIG. 2 illustrates an exemplary embodiment of a stabilization system according to the invention.
Figure 2A:
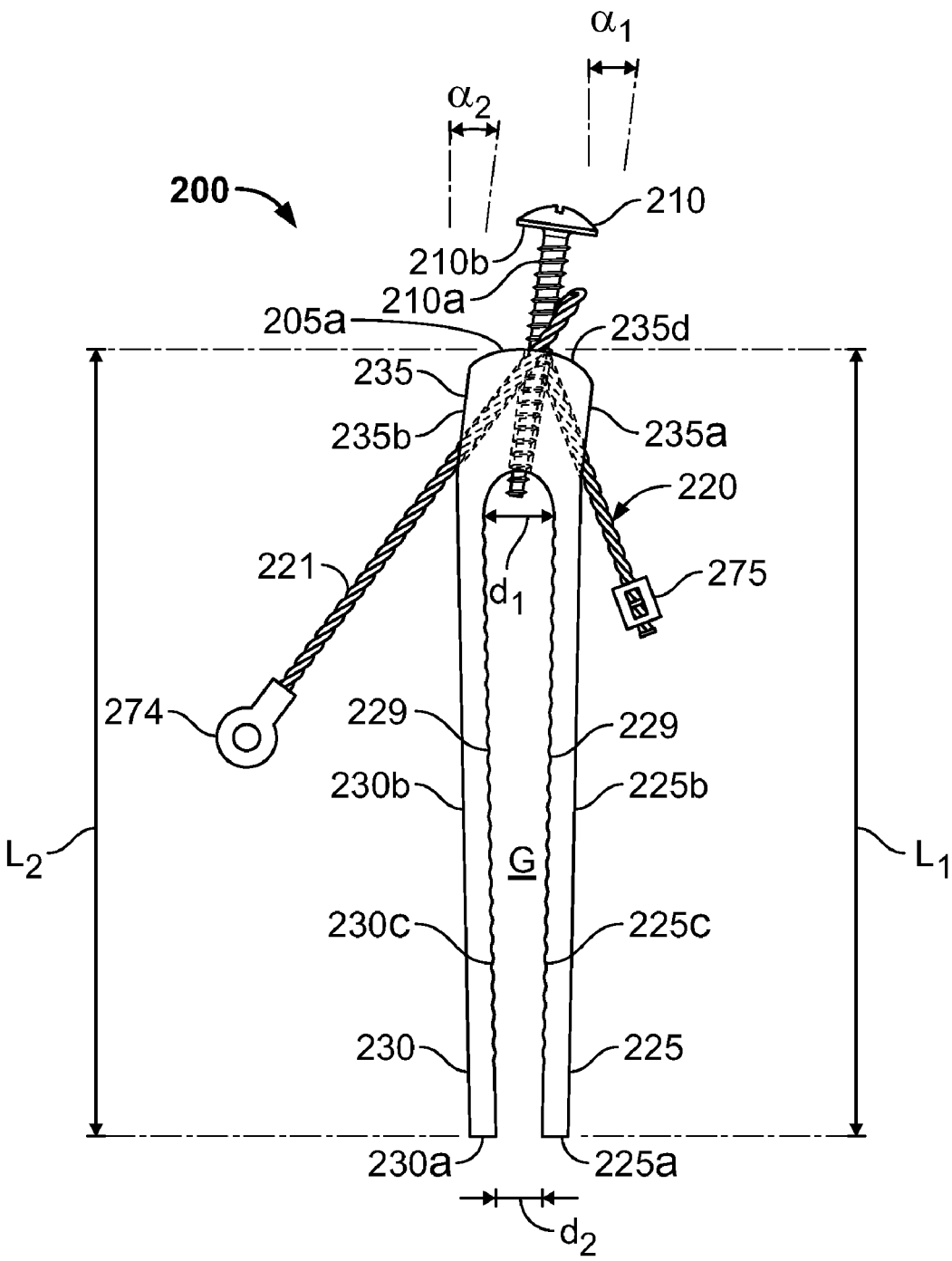
FIG. 2A is a side view of the stabilization system of FIG. 1.
Figure 2B:
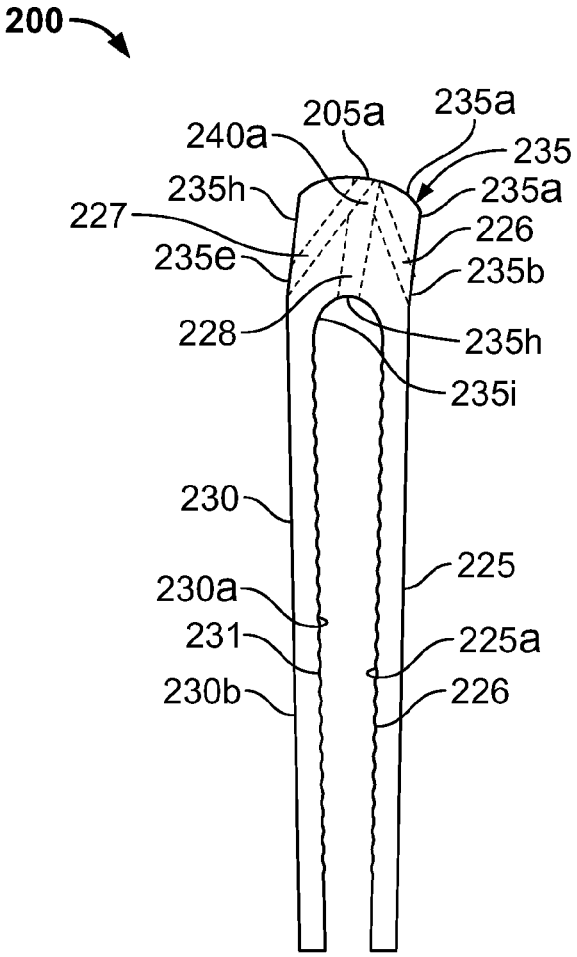
FIG. 2B is a side view of the stabilization system of FIG. 1 having the fastener and flexible link element removed.
Figure 2C:
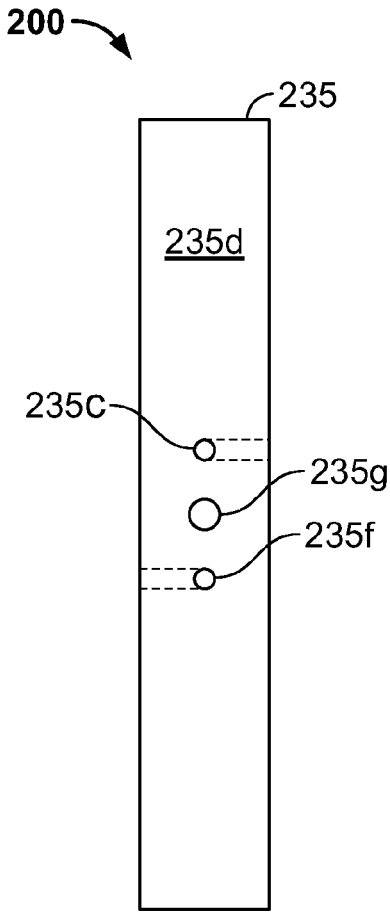
FIG. 2C is a top view of the stabilization system of FIG. 1 having the fastener and flexible link element removed.

FIGS. 2 and 2A illustrate an exemplary embodiment of a stabilization system 200 for stabilizing a vertically stacked bundle of sheet material 435 (FIG. 4) against a vertical structure 410 (FIG. 4) according to the invention. The stabilization system 200 includes a bracket 205, a fastener 210, and a flexible link element 220. FIGS. 2B and 2C show details of the bracket 205 having the fastener 210 and flexible link element 220 removed in order to more clearly show some features of the bracket 205.

The bracket 205 includes a front leg 225, a rear leg 230, and a top section 235 disposed between and joining the front leg 225 and the rear leg 230. In this exemplary embodiment, the bracket 205 is formed of a polymer. In another embodiment, the bracket 205 may be formed of a plastic, polymer, metal or composite material. In an embodiment, the polymer may be a thermoplastic. In another embodiment, the bracket 205 may be formed of a steel, aluminum or other metal. In another embodiment, the bracket 205 may be formed of an elastic, inelastic or deformable material. The bracket 205 may be formed by extruding, forming, molding, stamping, machining, punching, or other material shaping or forming technique.

Referring to FIG. 2A, the bracket 205 has a first length $L_1$ that extends from the bracket top end 205*a* to the front leg bottom end 225*a*. The bracket 205 also has a second length $L_2$ that extends from the bracket top end 205*a* to the rear leg bottom end 230*a*. In this exemplary embodiment, the first length $L_1$ and the second length $L_2$ are equal. The first and second lengths $L_1$, $L_2$, may have a length of between about 2 inches and about 8 inches. In another embodiment, the first and second lengths $L_1$, $L_2$, may have lengths of between about 2.5 inches and about 6 inches. In another embodiment, the first and second lengths $L_1$, $L_2$, may have lengths of between about 3.5 inches and about 5 inches. In yet another embodiment, the first length $L_1$ and the second length $L_2$ may be unequal. In another embodiment, the first length $L_1$ is less than the second length $L_2$. In another embodiment, the first length $L_1$ is about 5% to about 30% less than the second length $L_2$. In one embodiment, the second length has a length has a length of between about 2 inches and about 8 inches. In another embodiment, the first length $L_1$ is between about 1.5 inches to about 2.5 inches and the second length $L_2$ is between about 1.75 inches to about 3.25 inches. In another embodiment, the first length $L_1$ is about 1.75 inches and the second length $L_2$ is about 2.0 inches.

Referring to FIG. 2, the bracket 205 has a width W. The width W is greater than 2 inches. In another embodiment, the width W is between about 2 inches and about 10 inches. In another embodiment, the width W is between about 3 inches and about 6 inches. In another embodiment, the width W is about 4 inches.

Figure 4:
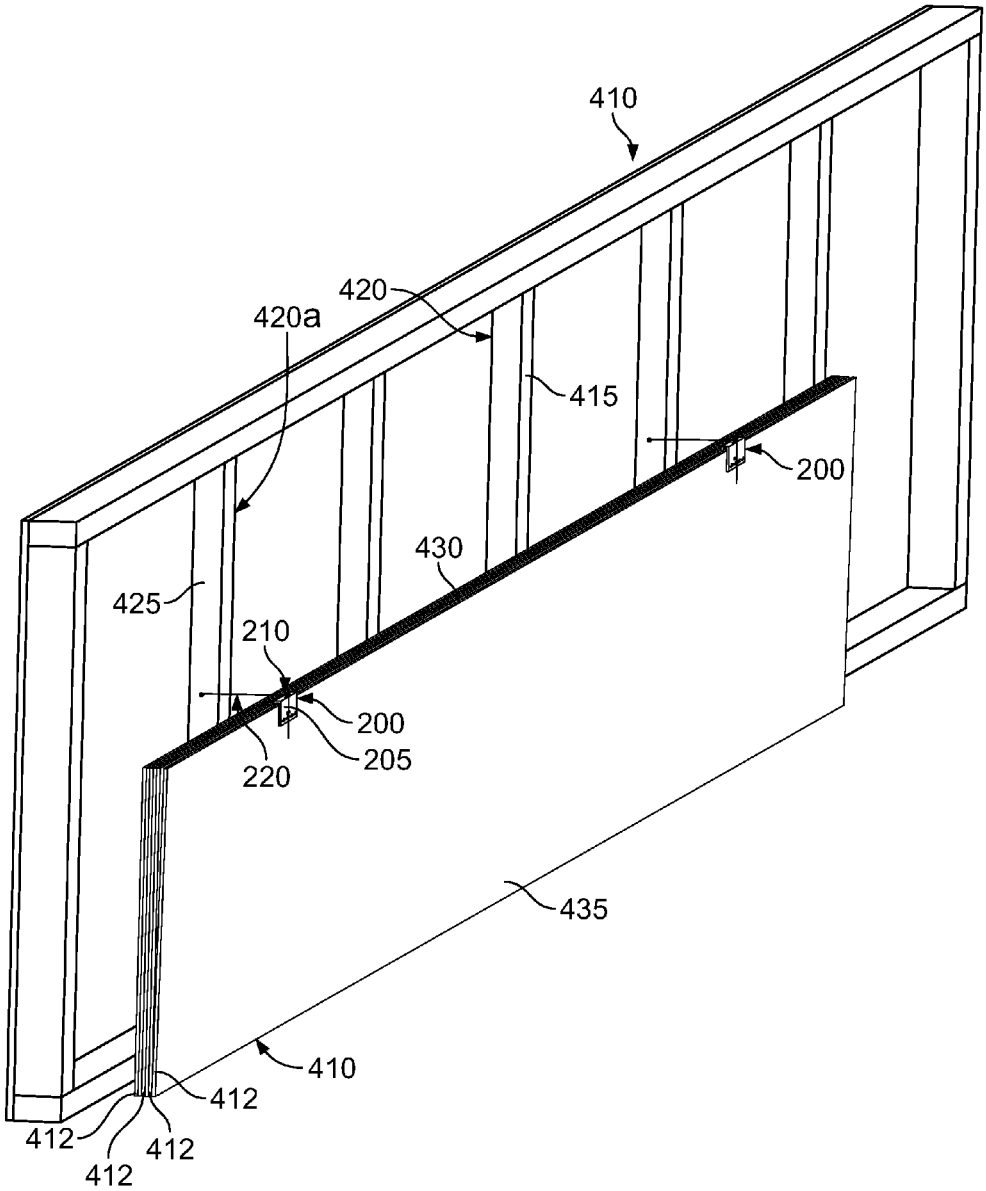
FIG. 4 illustrates another exemplary application of the stabilization system of FIG. 2.

Referring to FIG. 2A, the bracket 205 has a gap G between the inside surface 225*c* of the front leg 225 and the inside surface 230*c* of the rear leg 230. The gap G has a first distance $d_1$ proximate to the top section 235 and a second distance $d_2$ at the point between the front leg bottom end 225*a* and the rear leg bottom end 230*a*. In this exemplary embodiment, the first distance $d_1$ is greater than the second distance $d_2$. In an embodiment, the first distance $d_1$ is between about 0.35 inches and about 0.65 inches. In another embodiment, the first distance $d_1$ is between about 0.425 inches and about 0.475 inches. In another embodiment, the first distance $d_1$ is about 0.450 inches. In an embodiment, the second distance $d_2$ is between about 0.250 inches and about 0.5 inches. In another embodiment, the second distance $d_2$ is between about 0.275 inches and about 0.325 inches. In yet another embodiment, the second distance $d_2$ is about 0.30 inches. In embodiments where the front leg 225 and the rear leg 230 have different lengths, the second distance $d_2$ is the distance between the bottom end of shorter of the two legs and the opposing point of the longer leg. In another embodiment, the gap G has a constant distance between $d_1$ and $d_2$, having $d_1$ and $d_2$ selected from the ranges discussed above. In yet another embodiment, the gap G distances $d_1$ and $d_2$ have distances selected to fit over the width of one or more sheets of a bundle of sheet material 435 (FIG. 4).

The dimensions of the bracket 205 may vary considerably, and are dependent upon the thickness of the sheet material and strength of the material chosen to form the bracket 205. The dimensions may be determined by one of ordinary skill in the art based on the sheet material dimensions, bracket material and application so as to minimize the bracket dimensions, which reduce cost, and yet provide the desired degree of stability for the wallboard.

The inside surfaces 225*c* and 230*c* include a gripping feature 229. The gripping feature 229 provide increased friction and contact when the bracket 205 is placed over a sheet of material 435 as shown in FIG. 4. In this exemplary embodiment, the gripping feature 229 is a plurality of ridges. In another embodiment, the gripping feature 229 may include texturing, protrusions, tabs, or other friction devices. In yet another embodiment, one or both of the inside surfaces 225*c* and 230*c* may be smooth.

The top section 235 is inclined at a first angle $\alpha_1$ between the plane of the outside or front surface 225*b* of the front leg 225 and the plane of the front surface 235*a* of the top section 235. The first angle $\alpha_1$ is greater than 0 degrees and up to 45 degrees. In another embodiment, the first angle $\alpha_1$ is between about 2 degrees and about 35 degrees. In another embodiment, the first angle $\alpha_1$ is between about 5 degrees and about 20 degrees. In another embodiment, the first angle $\alpha_1$ is between about 8 degrees and about 15 degrees. In another embodiment, the first angle $\alpha_1$ is zero.

The bracket 205 includes a second angle $\alpha_2$ between the plane of the outside or rear surface 230*b* of the rear leg 230 and the plane of the rear surface 235*b* of the top section 235. In this exemplary embodiment, the first angle $\alpha_1$ and the second angle $\alpha_2$ are equal. In another embodiment, the first angle $\alpha_1$ and the second angle $\alpha_2$ may be different. In another embodiment, the second angle $\alpha_2$ may be zero.

Referring to FIGS. 2B and 2C, the bracket 205 includes a front through-hole 226 that extends from a front hole 235*b* in the front surface 235*a* of the top section 235 to a front top hole 235*c* in the top surface 235*d* of the top section 235. The front through-hole 226 traverses diagonally through the top section 235.

The bracket 205 further includes a rear through-hole 227 that extends from a rear hole 235*e* in the rear surface 235*h* of the top section 235 to a rear top hole 235*f* in the top surface 235*d* of the top section 235. The rear through-hole 227 traverses diagonally through the top section 235. The front top hole 235*c* and the rear top hole 235*f* are positioned on opposite sides of a top fastener hole 235*g*.

Referring to FIGS. 2A, 2B and 2C, the fastener 210 is configured to releasably secure the flexible link element 220 to the bracket 205. The fastener 210 includes a threaded portion 210*a* and a head portion 210*b*. The fastener 210 is received in a top through-hole 228 that traverses from a top hole 235*g* in the top surface 235*d* of the top section 235 to an inside hole 235*h* on a interior bottom surface 235*i* of the top section 235. In this exemplary embodiment, the fastener 210 is a threaded screw that that is received into through-hole 228. In another embodiment, the fastener 210 may be any threaded fastener capable of being received in through-hole 228.

As can be seen in FIGS. 2 and 2A, the fastener 210 has been partially received in through-hole 228, but has not been fully received or tightened into the through-hole 228. This configuration may be referred to as an initial position. In the initial position, the length of the flexible link element 220 extending from the front and rear surfaces 235*a*, 235*b* of the top portion 235 may be adjusted by pulling the flexible link element 220 through the bracket 205 on either the front side 235*a* or rear side 235*b* of the top section 235.

Figure 2D:
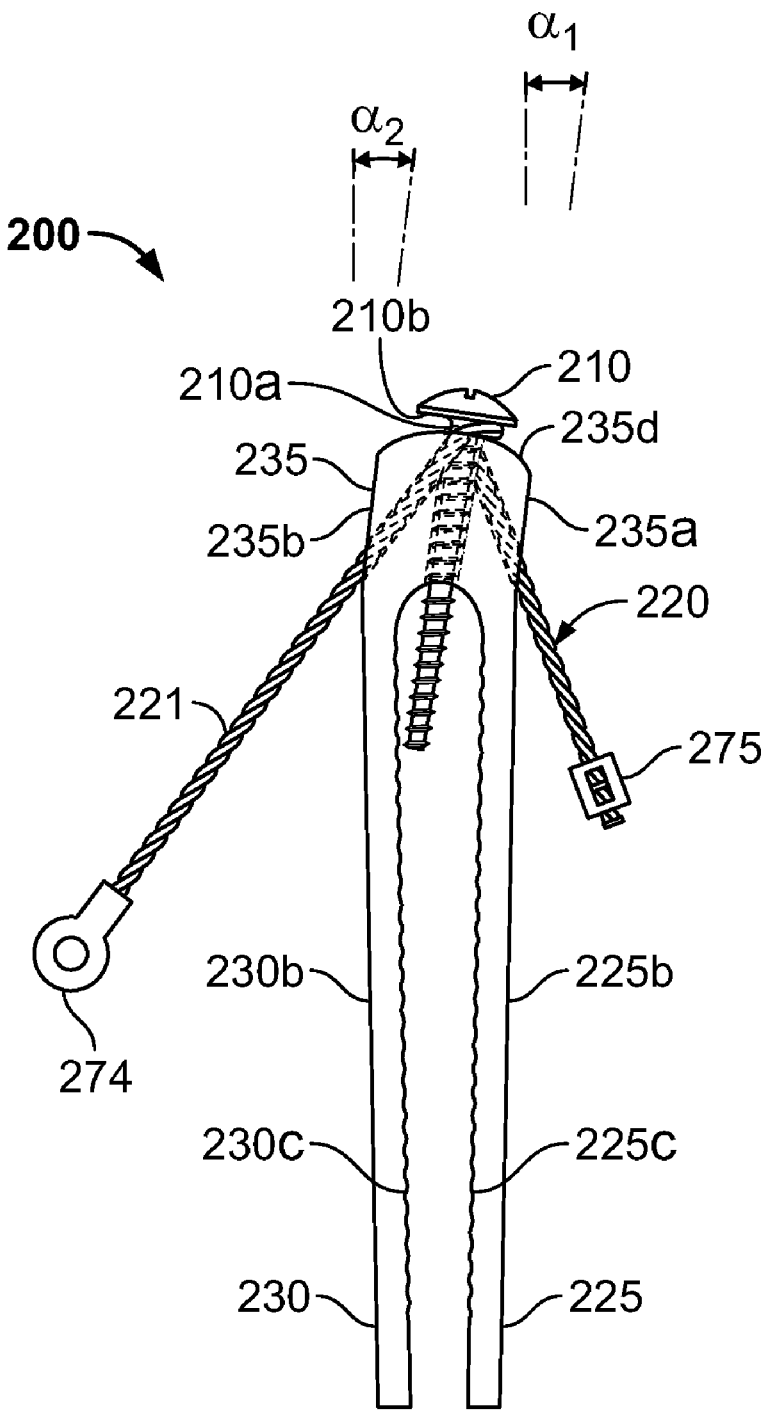
FIG. 2D is a side view of the stabilization system of FIG. 1 having the fastener tightened.

FIG. 2D shows the fastener 210 being been fully received in the through-hole 228 such that the head portion 210*b* securely retains the flexible link element 220 against the bracket 205, and in particular, against the top surface 235*d* of the top section 235. This configuration may be referred to as a secured position. In the secured position, the flexible link element 220 may not be pulled through the bracket 205.

Referring again to FIGS. 2, 2A, and 2D, the flexible link element 220 includes a flexible member 221, a fastener 274 and a terminal clamp 275. In this exemplary embodiment, the flexible member 221 is a braided wire cable. In another embodiment, the flexible member 221 may be a metal, polymer or composite flexible member. In another embodiment, the flexible member 221 may be a wire, cable, or other elongated member. For example, the flexible member 221 may be a stranded steel wire having a diameter of between about 3/64 inch to about ¼ inch, and preferably be a ⅙ inch diameter 7 strand steel wire, commonly referred to as 7×7 wire, having a break strength of about 480 lbs.

One end of the flexible member 221 is terminated or connected to the fastener 274. The fastener 274 may be formed of metal, ceramic, or plastic material. In this exemplary embodiment, the fastener 274 is a metal eyelet fastener for receiving another fastener such as a fine thread drywall screw, screw, nail, or other similar fastener (not shown) for attaching the fastener 274 to a surface. In another embodiment, the fastener 274 may be a hook, clamp, or other fastener for attaching the flexible member 221 to a surface or surface feature. In this exemplary embodiment, the fastener 274 is attached to the flexible member 221 by crimping. In another embodiment, the fastener 274 may be attached to the flexible member 221 by another joining method, such as, but not limited to crimping, soldering, gluing or other similar methods.

The flexible member 221 is terminated at the opposite, opposing end to the fastener 274 by a terminal 275 that prevents the braided cable from unwrapping, and which provides a surface for a user to grip and/or hold the flexible link element 220. In another embodiment, the terminal 255 may be a sleeve, coupling, or other device that assists an operator in grasping the flexible member 221. In another embodiment, the terminal 275 may be omitted.

Figure 3:
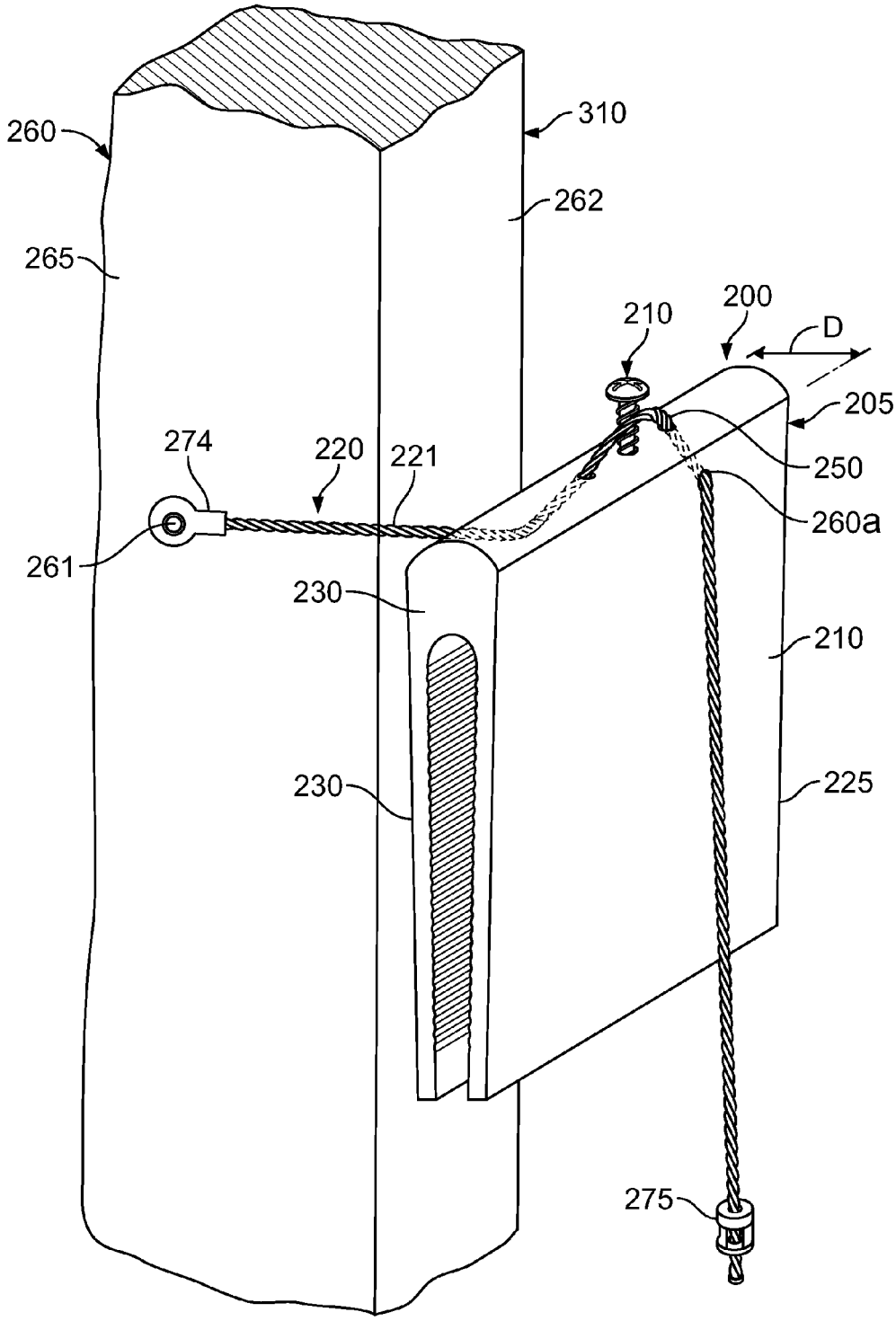
FIG. 3 illustrates an exemplary application of the stabilization system of FIG. 2.

FIG. 3 illustrates an embodiment of an application of the stabilization system 200 according to the invention. The stabilization system 200 is in an initial configuration. As can be seen in FIG. 3, the stabilization system 200 has been securely attached to a vertical support member 260. The stabilization system 200 has been attached to the vertical support member 260 by a fastener 261, which has securely attached the fastener 272 to the stationary member 260. The fastener 261 may be a screw, nail, or other similar fastener.

In this exemplary embodiment, the vertical support member 260 is a wall stud. In another embodiment, the vertical support member 260 may be a frame member, wall stud, or other similar fixed or stationary member. The fastener 274 has been attached to a side surface 265 of the vertical support member 260. In another embodiment, the fastener 274 may be attached to the front surface 262, rear surface (not shown) or other surface of the vertical support member 260. The fastener 274 is preferably attached to the side surface 265 instead of the front surface 262 to increase retention strength of the stabilization system 200 against the stationary member 260, as would be appreciated by one of ordinary skill in the art.

FIG. 4 illustrates an exemplary embodiment of the stabilization system 200 securely stabilizing a plurality or bundle 410 of individual sheets of wallboard 412 that has been vertically stacked or disposed against front surfaces 415 of studs 420. The bundle 410 may include 26 to 30 individual sheets of wallboard 412 having a thickness of between about ¼ inch and about 1 inch, although fewer sheets are depicted for illustration purposes. In this exemplary embodiment, the wallboard are 4 ft. by 12 ft. sheets, however it should be appreciated by one of ordinary skill in the art that the wallboard may be 4 ft. by 8 ft. sheet, 4 ft by 16 ft. sheets, or other sized sheets as known in the art. It should also be appreciated by one of ordinary skill that fewer or greater than 26 to 30 individual sheets may be stabilized by the stabilization system 200.

As can be seen in FIG. 4, the flexible link element 220 has been attached to a side surface 425 of a stud 420*a* by attaching the fastener 274 to the side surface 425, and the bracket 205 has been placed over the outer sheet of wallboard 435. The length of the flexible link element 220 has been adjusted so that the flexible link element 220 is taught between the outer sheet of wallboard 435 and stud 420*a*. The fastener 210 of the stabilization system 200 has tightened as shown in FIG. 2B, so as to secure the flexible link element 220 at a fixed length from the stud 220*a*. As can be appreciated from FIG. 4, very little of the force from the weight of the bundle 410 is acts upon the stabilization system 200 because of the substantially vertical orientation of the bundle of wallboard 410 as shown. In this exemplary embodiment, two stabilization systems 200 have been used to provide increased safety and redundancy. Alternatively, one or more stabilization systems 200 may be used to provide the degree of safety desired.

Several exemplary methods may be used to remove individual sheets 430 from the bundle 410. In an embodiment, the bracket 205 may be pulled vertically upward and removed from the outer sheet of wallboard 435 and sheets of wallboard 412 may be removed from the bundle 410. The fastener 210 may then be loosened from the bracket 205, the length of the flexible link element 220 may be adjusted between the new outer sheet of wallboard 412, and the fastener 210 may be retightened to stabilize the bundle 410 against the studs 420. In another embodiment, the adjustable link element 220 may be cut between the bracket 210 and the fastener 274 to provide access to individual sheets of wallboard 412, and a new stabilization system 200 may be used to re-stabilize the remaining bundle 410, if necessary.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A stabilization system for stabilizing a vertically oriented sheet of material, comprising a bracket comprising a front leg, a rear leg separated by a gap from the front leg, and a top section disposed between the front leg and the rear leg;

a flexible link element traversing through the top section; and a fastener configured to securely retain the flexible link element at a fixed position;

wherein the top section comprises a front surface, a rear surface, and a top surface disposed between the front surface and rear surface; and wherein the top section includes a first through-hole between the front surface and the top surface, and a second through-hole between the rear surface and the top surface, the first and second through-holes receiving the flexible link element therethrough.

2. The system of claim 1, wherein the top portion is inclined at an angle greater than 0 degrees at the junction of the front surface of the top portion and a front surface of the front leg.

3. The system of claim 1, wherein the fastener is configured to secure the flexible link element against the top surface of the top section when fully received in the top section.

4. The system of claim 1, wherein the gap has a first distance proximate the top portion, and a second distance proximate to a bottom end of the front or rear legs, and wherein the first distance is greater than the second distance.

5. The system of claim 1, wherein the flexible link element comprises a flexible member and a fastener attached to a first end of the flexible member.

6. The system of claim 1, wherein the bracket is formed of a plastic or polymer material.

7. The system of claim 1, wherein the bracket is formed of a metal.

8. The system of claim 1, wherein the flexible member is a metal wire and the fastener comprises an eyelet.

9. A method for stabilizing a vertically stacked bundle of sheet of material, comprising:

providing one or more vertically stacked sheets of material supported against a vertical support surface;

mounting a bracket over a top edge of an outer sheet of the vertically stacked bundle of sheet of material;

securing a flexible link element that is attached to the bracket to a component of the vertical support surface;

passing the flexible link element through a first through-hole disposed between a front surface of the bracket and a top section of the bracket, and a second through-hole disposed between a rear surface of the bracket and the top surface of the bracket; and securely fastening the flexible link element against a top surface of the top section when fully received in the top section of to stabilize the vertically stacked sheet of material against the vertical support surface; and wherein the bracket comprises: a front leg, a rear leg separated by a gap from the front leg, and the top section disposed between the front leg and the rear leg.

10. The method of claim 9, wherein the one or more vertically stacked sheets of a material are one or more vertically stacked sheets of wallboard.

11. The method of claim 9, wherein the flexible link element comprises a metal wire and a fastener disposed at one end of the metal wire.

12. The method of claim 1, wherein the gap has a first distance proximate the top portion, and a second distance proximate to a bottom end of the front or rear legs, and wherein the first distance is greater than the second distance.

13. The method of claim 1, wherein two or more brackets are used to stabilize the vertically stacked sheet of material.

* * * * *